US008155359B2

(12) United States Patent
Beck

(10) Patent No.: US 8,155,359 B2
(45) Date of Patent: Apr. 10, 2012

(54) HEARING SYSTEM WITH REMOTE CONTROL AS A BASE STATION AND CORRESPONDING COMMUNICATION METHOD

(75) Inventor: Frank Beck, Spardorf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1209 days.

(21) Appl. No.: 11/975,328

(22) Filed: Oct. 18, 2007

(65) Prior Publication Data

US 2008/0123865 A1 May 29, 2008

(30) Foreign Application Priority Data

Oct. 18, 2006 (DE) ..... 10 2006 049 213

(51) Int. Cl.
*H04R 25/00* (2006.01)

(52) U.S. Cl. ..... 381/315; 455/524

(58) Field of Classification Search ..... 381/315; 455/524

See application file for complete search history.

(56) References Cited

U.S. PATENT DOCUMENTS

| | | | | |
|---|---|---|---|---|
| 2004/0116108 | A1 * | 6/2004 | Ra | 455/418 |
| 2006/0245609 | A1 | 11/2006 | Arz et al. | |
| 2007/0042762 | A1 * | 2/2007 | Guccione | 455/416 |
| 2007/0291969 | A1 * | 12/2007 | Tateno et al. | 381/315 |
| 2008/0031478 | A1 * | 2/2008 | Alber et al. | 381/315 |

FOREIGN PATENT DOCUMENTS

| | | | |
|---|---|---|---|
| DE | 103 45 173 | B3 | 1/2005 |
| DE | 10 2005 005 603 | A1 | 8/2006 |
| DE | 10 2005 020 315 | A1 | 11/2006 |
| EP | 1643801 | A2 | 4/2006 |
| JP | 05068148 | A | 3/1993 |
| JP | 200424315 | A | 8/2004 |
| JP | 2005167750 | A | 6/2005 |

* cited by examiner

*Primary Examiner* — David Vu
*Assistant Examiner* — Brandon Fox

(57) ABSTRACT

Hearing-aid wearers should be able to converse unimpeded even in noisy environments. Provided for this is a hearing system with a first hearing device, a second hearing device and a remote control for the operation of the first and/or second hearing device. The remote control is embodied as a base station to which the first and second hearing device is able to log on to establish a spontaneous communication network. This facilitates a wireless communication using a remote control as a relay station and without the influence of background noise.

10 Claims, 2 Drawing Sheets

HEARING SYSTEM WITH REMOTE CONTROL AS A BASE STATION AND CORRESPONDING COMMUNICATION METHOD

CROSS REFERENCE TO RELATED APPLICATIONS

This application claims priority of German application No. 102006049213.7 DE filed Oct. 18, 2006, which is incorporated by reference herein in its entirety.

FIELD OF INVENTION

The present invention relates to a hearing system with a first hearing device and a second hearing device. In addition, the present invention relates to a method for communication between hearing devices. Here the term hearing device should be understood to mean any portable and non-portable acoustic device, but in particular a hearing aid, a headset or headphones.

BACKGROUND OF INVENTION

Hearing aids are portable hearing devices provided to people with impaired hearing. In order to accommodate the numerous individual requirements, different designs of hearing aids are provided, such as, for example, behind-the-ear-hearing aids (BTEs), in-the-ear-hearing aids (ITEs) and concha-hearing aids. The hearing aids described by way of example are worn on the outer ear or in the auditory canal. In addition, also available on the market are bone conduction hearing aids, implantable or vibrotactile hearing aids. In such cases, the damaged hearing is stimulated either mechanically or electrically.

In principle, hearing aids have the following essential components: an input transducer, an amplifier and an output transducer. The input transducer is generally a sound pickup, for example a microphone, and/or an electromagnetic receiver, for example an induction coil. The output transducer is generally implemented as an electroacoustic transducer, for example a miniature loudspeaker, or as an electromechanical transducer, for example a bone conduction hearing aid. The amplifier is usually integrated in a signal processing unit. This basic structure is shown in FIG. 1 using the example of a behind-the-ear hearing aid. One or more microphones 2 to pick up the sound from the environment are integrated in a hearing aid housing 1 for wearing behind the ear. A signal processing unit 3, which is also integrated in the hearing aid housing 1 processes and amplifies the microphone signals. The output signal from the signal processing unit 3 is transmitted to a loud speaker or receiver 4, which issues an acoustic signal. The sound may optionally be transmitted via an acoustic tube, which is fixed in the auditory canal with an otoplastic, to the eardrum of the person wearing the device. The power supply for the hearing aid and in particular for the signal processing unit 3 is provided by a battery 5 which is also integrated in the hearing aid housing 1.

SUMMARY OF INVENTION

One particular problem is the provision of sound to a hearing aid wearer in an environment with background noise. For example, if two hearing aid wearers wish to converse with each other unimpeded in an environment with background noise, suitable measures need to be taken to suppress the background noise. To date, attempts have been made to suppress the background noise to the greatest degree possible with the aid of directional microphones. However, also known are so-called "companion mics" which speakers can hang around their necks so that they can converse unimpeded, possibly even at greater distances.

In addition, known for example from publication DE 100 47 759 is the transmission of control parameters from a first hearing aid to another hearing aid. The transmission of the control parameters is performed in order to control the signal processing of the receiving device and to improve the signal quality.

In addition, a converter unit for wireless data transmission in hearing aids with a high-frequency receive unit to receive high-frequency signals from an external transmit unit is known from the subsequently published publication DE 10 2005 005 603. To mix the high-frequency signal with a reference signal of a similarly high frequency, the converter unit has a corresponding mixing unit. This may be used to generate an output signal with a frequency which is lower by at least one order of magnitude and is suitable for inductive transmission. This enables even long radio links to be bridged.

As a rule, two different options are used for the transmission of digital signals between hearing aids: high-frequency (HF) far field transmission and inductive near field transmission. Both variants have advantages and disadvantages. The HF transmission usually takes place in the range from 800 to 1000 MHz, whereas the inductive transmission takes place in the range from 1 to 30 MHz. The range for hearing aid applications is approximately 10 m with HF transmission, whereas it is only 1 m with inductive transmission. Particular drawbacks with HF transmission are that the absorption of the electromagnetic signals in the body, the antenna dimensions and the power consumption of the receiver are considerable. In contrast, with signals for inductive transmission, absorption in the body is low and the dimensions of an induction coil for the transmission and the power consumption of the receiver are small.

DE 103 45 173 B3 describes a modular remote control for hearing aids. This remote control unit comprises a base module the functionality of which can be expanded by connecting an expansion module. This enables the remote control to be adapted to the individual requirements and needs of a user in a simple way. In one embodiment, the remote control comprises means for data transmission between the remote control and a further device different from the hearing aid. This concept can involve a data network or even the wireless programming of the hearing aid by means of a programming device.

DE 10 2005 020 315 A1 which was published after the filing date of the present application describes a hearing aid remote control which is integrated as a component in a network, for example a home network. The application is concerned in particular with how data from the home network can be coupled into individual hearing aids.

The object of the present invention is to facilitate conversations between users of hearing devices with as little interference as possible.

According to the invention, this object is achieved by a hearing system with a first hearing device and a second hearing device, and a remote control for the operation of the first and/or second hearing device, with the remote control being embodied as a base station to which the first and second hearing device can log on to establish a spontaneous communication network.

In addition, according to the invention, a method is provided for communication between a first hearing device and a second hearing device, by the provision of a remote control for the operation of the first and/or second hearing device, the logging on of the first and second hearing device to the remote control as a base station so that a spontaneous communication network is established and the first hearing device can communicate with the second hearing device via the remote control.

Therefore, it is possible in an advantageous way for users of hearing devices to converse unimpeded in a noisy environment. This also exploits the circumstance that a remote control is used as a relay station so that in general longer radio links can be bridged than for example in the case of direct communication between small hearing aids.

Preferably, each of the above-named hearing devices of the hearing system according to the invention has a microphone for voice communication over the communication network. This enables not only data communication between the hearing devices but also the transmission of conversations as already suggested above.

In addition, it can be possible for at least one further remote control to log on to the communication network so that at least one third hearing device, which has a communication link with the further remote control, is able to communicate with the first and/or second hearing device via the communication network. Therefore, it is possible not only for further hearing devices to log on to the first remote control but also for the communication network to be further expanded as desired with further remote controls and hearing devices connected thereto.

According to another preferred embodiment, a communication link may be established via several subscribers in the communication network. For this, one or more hearing devices also function as relay stations.

In addition, the hearing system according to the invention can comprise a module for different transmission standards so that hearing devices with different transmission standards can communicate with each other via the module. This means it is possible for hearing devices and in particular hearing aids made by different manufacturers to communicate with each other for example via different communication protocols or via different physical communication layers.

A module of this kind can for example be integrated in a remote control. This means the remote control has the function of an intelligent relay station with converter functionality.

In addition, at least one of the two hearing devices of the hearing system according to the invention can comprise two hearing aids for binaural provision to a hearing-aid wearer. These two hearing aids can then be treated as a unitary communication subscriber in the communication network. However, there is also a possibility of addressing each of the two hearing aids in the communication network separately and treating them as separate communication subscribers. This enables the advantage of binaural provision to be exploited when communicating in an noisy room.

BRIEF DESCRIPTION OF THE DRAWINGS

The present invention will now be explained in more detail with reference to the attached drawings, which show.

DETAILED DESCRIPTION OF INVENTION

The exemplary embodiments described in more detail below represent preferred embodiments of the present invention.

Figure 1:
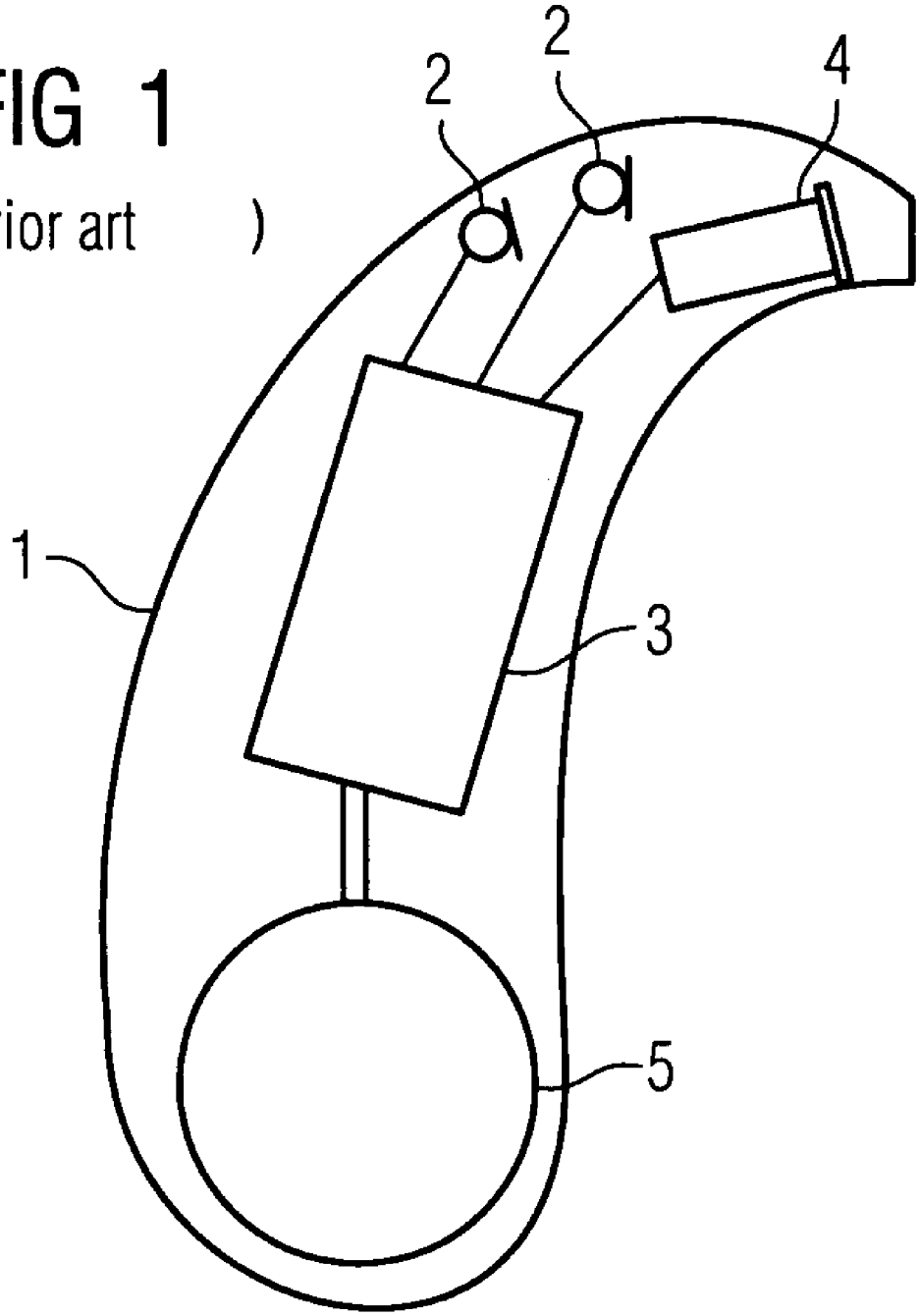
FIG 1 ( Prior art )
FIG. 1 the basic structure of a hearing aid.
Figure 2:
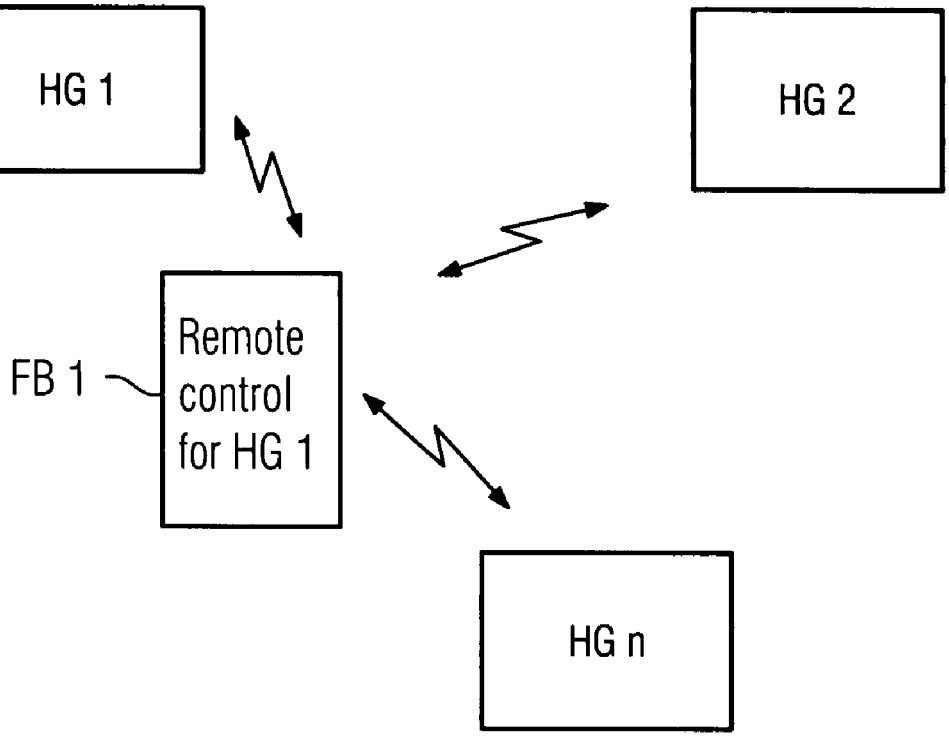
FIG. 2 a block diagram of a communication network according to the invention.

According to the example in FIG. 2, a hearing-aid wearer has a hearing aid HG1 and a remote control FB1 associated therewith. The hearing aid HG1 and the remote control FB1 are connected to each other in a wireless manner. The hearing aids HG2 and HGn also have a communication link with the remote control FB1. Therefore, a communication network is formed so that the hearing-aid wearers are able to converse unimpeded via their respective hearing aids via wireless (electromagnetic, optical, etc.) links. The wireless remote control FB1 hereby manages several hearing aids or hearing systems as a relay station. A hearing system of this kind can, for example, comprise two hearing aids for binaural provision to a hearing-aid wearer.

As with a bluetooth or a mobile radio network, it is possible for several hearing aids to log on simultaneously to a remote control unit of an individual hearing-aid wearer. The remote control unit then has the function of a base station. In the present example in FIG. 2, three hearing aids HG1, HG2, HGn are logged on to the base station, namely the remote control FB1. Therefore, wireless voice or data communication is possible between these three hearing aids via the remote control FB1.

A hearing-aid wearer's own voice is picked up for example by an auditory canal microphone or directional microphone and transmitted via the base station to one or all logged-on hearing-aid wearers or their hearing aids. As long as it is a voice signal, the received signal is processed immediately in the respective hearing aid and converted into an acoustic signal so that it can be perceived by the hearing-aid wearer with virtually no delay.

The spontaneous communication network can be expanded by one or more further remote controls (ie base stations). These log on to each other and control the data transfer optionally also over further links. Hereby, the "network" of base stations continuously searches for the best transmission route via all the logged-on base stations.

According to a further exemplary embodiment, a module for different transmission standards of different hearing-aid manufacturers is used in a communication network as described above. The module takes over conversion tasks in order, for example, to convert a signal corresponding to a first transmission standard into a signal of a second transmission standard. Therefore, wearers of hearing aids made by different manufacturers can subscribe to one and the same hearing aid communication network.

The above described hearing aid communication network permits meaningful communication even in noisy environments without further ado. Hereby, it is in principle irrelevant how many users are logged on to the network. Optionally, several modes are made available so that in one mode the user addresses all other subscribers and in another mode selectively addresses one or a selection of users. In addition, it is possible to use the system dynamically so that anybody can join in and leave without having to change the system. A further advantage is the fact that no additional chest microphones are required for this wireless communication.

The invention claimed is:

1. A hearing system to facilitate voice transmissions in an environment when communication between hearing device wearers via their respective hearing devices is impeded by noise, comprising:

a plurality of hearing devices adapted to process input signals from a surrounding environment in accordance with a respective wearer's hearing impairment, each hearing device comprising a microphone, a first remote control for controlling a first hearing device, wherein the first remote control, when logged on to by the plurality of hearing devices, further operates as a base station establishing a spontaneous communication network between and among the first hearing device and the hearing devices of further hearing device wearers, wherein the base station is adapted to receive via the communication network each respective wearer's own voice transmissions picked up by each respective wearer's own microphone, and then transmit via the communication network the voice transmissions between and among the first hearing device and the further hearing devices to then be processed into acoustic signals for the wearers of the hearing devices, rather than the hearing devices processing input signals from the surrounding environment that are impeded by noise.

2. The hearing system as claimed in claim 1, wherein the microphone of one or more of the hearing devices comprises a directional microphone or an auditory canal microphone of the hearing device for voice communication via the communication network, without using an additional chest microphone.

3. The hearing system as claimed in claim 1, further comprising:

one or more further remote controls that log on to each other forming a network of logged-on base stations to expand the spontaneous communication network and allow for best transmission route searching across the logged-on base stations.

4. The hearing system as claimed in claim 1, wherein each hearing device logged on to the base unit comprises a subscriber to the communication network, wherein a mode selection provides for selective addressing of some or all of the subscribers.

5. The hearing system as claimed in claim 1, further comprising a module to translate between different transmission standards of the hearing devices so that the first hearing device, which has a different transmission standard than one or more of the further hearing devices, communicates with the one or more further hearing device via the module.

6. The hearing system as claimed in claim 5, wherein the module is integrated in the first remote control.

7. The hearing system as claimed in claim 4, wherein one or more of the hearing devices comprises two hearing aids for binaural provision to a hearing-aid wearer, wherein the two hearing aids are treated as either a unitary subscriber to the communication network or as separate communication subscribers.

8. A method to facilitate voice transmissions between hearing device wearers via their respective hearing devices, comprising:

establishing a spontaneous communication network between and among a first hearing device of a hearing device wearer and one or more hearing devices of further hearing device wearers via a log on to a remote control acting as a base station, the hearing devices adapted to process input signals from a surrounding environment in accordance with a respective wearer's hearing impairment, each hearing device comprising a microphone; and communicating between and among the first hearing device and the one or more hearing devices via the remote control by receiving via the communication network each respective wearer's own voice transmissions picked up by each respective wearer's own microphone, and then selectively transmitting via the communication network the voice transmissions between and among the first hearing device and the further hearing devices for processing into acoustic signals for the wearers of the hearing devices, rather than the hearing devices processing input signals from the surrounding environment and being impeded by background noise.

9. The method as claimed in claim 8, further comprising expanding the network via one or more further remote controls that log on to each other forming a network of logged-on base stations to expand the spontaneous communication network and allow for best transmission route searching across the logged-on base stations.

10. The method as claimed in claim 8, further comprises converting communication between the devices when the devices include different transmission standards.

* * * * *